US009664370B2

(12) United States Patent
Van Der Merwe et al.

(10) Patent No.: US 9,664,370 B2
(45) Date of Patent: May 30, 2017

(54) CONTROLLABLE LIGHTING ASSEMBLY

(71) Applicant: PHILIPS LIGHTING HOLDING B.V., Eindhoven (NL)

(72) Inventors: Jaco Van Der Merwe, Riethoven (NL); Roger Henri Denker, Eindhoven (NL); Yacouba Louh, Eindhoven (NL); Dennis Johannes Antonius Claessens, Eindhoven (NL); Marijn Geels, Eindhoven (NL); Lambertus Adrianus Marinus De Jong, Son (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/391,400

(22) PCT Filed: Apr. 10, 2013

(86) PCT No.: PCT/IB2013/052856

§ 371 (c)(1),
(2) Date: Oct. 9, 2014

(87) PCT Pub. No.: WO2013/153522

PCT Pub. Date: Oct. 17, 2013

(65) Prior Publication Data

US 2015/0109781 A1 Apr. 23, 2015

Related U.S. Application Data

(60) Provisional application No. 61/623,135, filed on Apr. 12, 2012.

(51) Int. Cl.
*F21S 4/00* (2016.01)
*F21V 21/00* (2006.01)
(Continued)

(52) U.S. Cl.
CPC ..... *F21V 29/70* (2015.01); *F21K 9/23* (2016.08); *F21V 23/005* (2013.01);
(Continued)

(58) Field of Classification Search
CPC ..... H05B 37/0272; F21V 23/005; F21V 23/0435; F21K 9/1355
See application file for complete search history.

(56) References Cited

U.S. PATENT DOCUMENTS

2003/0020417 A1 1/2003 Williams et al.
2005/0141221 A1* 6/2005 Yu ..... H05B 37/0272 362/253

(Continued)

FOREIGN PATENT DOCUMENTS

NL WO 2010140136 A1 * 12/2010 ..... H01Q 1/38
WO 2007096789 A1 8/2007

(Continued)

*Primary Examiner* — Peggy Neils
*Assistant Examiner* — William N Harris

(57) ABSTRACT

The present invention relates to a lighting assembly (100), comprising at least one light source (402), a heat sink (102) for dissipating heat generated during operation of the at least one light source (402), a lamp foot for connecting the at least one light source to a power supply, a control unit for controlling the at least one light source, and a first antenna arrangement (204) connected to the control unit and being electrically insulated from the heat sink (102) and the lamp foot (104), wherein the heat sink (102) and the lamp foot (104) form a second antenna arrangement (108), and the first antenna arrangement (204) is arranged in close vicinity of the second antenna arrangement (108) for allowing near-field coupling of a radio frequency signal provided to control the at least one light source (402).

10 Claims, 2 Drawing Sheets

(51) Int. Cl.

| | |
|---|---|
| ***F21V 29/70*** | (2015.01) |
| ***F21V 23/04*** | (2006.01) |
| ***F21V 23/00*** | (2015.01) |
| ***H01Q 1/22*** | (2006.01) |
| ***H01Q 9/16*** | (2006.01) |
| ***H05B 37/02*** | (2006.01) |
| ***F21K 9/23*** | (2016.01) |

(52) U.S. Cl.
CPC ..... *F21V 23/045* (2013.01); *F21V 23/0435* (2013.01); *H01Q 1/22* (2013.01); *H01Q 9/16* (2013.01); *H05B 37/0272* (2013.01)

(56) References Cited

U.S. PATENT DOCUMENTS

| | | | | |
|---|---|---|---|---|
| 2007/0195544 | A1* | 8/2007 | Graves | F21K 9/13 362/510 |
| 2008/0054729 | A1* | 3/2008 | Greene | H02J 17/00 307/149 |
| 2008/0211369 | A1* | 9/2008 | Zhang | F21K 9/00 313/45 |
| 2011/0006898 | A1 | 1/2011 | Kruest et al. | |
| 2011/0228130 | A1 | 9/2011 | Egawa | |
| 2014/0292194 | A1* | 10/2014 | Sagal | F21K 9/1355 315/34 |

FOREIGN PATENT DOCUMENTS

| | | | |
|---|---|---|---|
| WO | 2008012533 | A1 | 1/2008 |
| WO | 2010140136 | A1 | 12/2010 |
| WO | 2010148019 | A2 | 12/2010 |
| WO | 2012025742 | A1 | 3/2012 |

* cited by examiner

CONTROLLABLE LIGHTING ASSEMBLY

CROSS-REFERENCE TO PRIOR APPLICATIONS

This application is the U.S. National Phase application under 35 U.S.C. §371 of International Application No. PCT/IB2013/052856, filed on Apr. 10, 2013, which claims the benefit of U.S. Provisional Patent Application No. 61/623,135, filed on Apr. 12, 2012. These applications are hereby incorporated by reference herein.

TECHNICAL FIELD

The present invention relates to the field of lighting, and more specifically to a wirelessly controllable lighting assembly having an integrated antenna configuration at least partly formed by structural components of the lighting assembly.

BACKGROUND OF THE INVENTION

Light emitting diodes, LEDs, are employed in a wide range of lighting applications. As LEDs have the advantage of providing controllable light in a very efficient way, it is becoming increasingly attractive to use LEDs as an alternative light source instead of traditional incandescent and fluorescence light sources. Furthermore, LEDs are advantageous since they may allow for simple control in respect to e.g. dimming and color setting. This control may be realized through wireless radio frequency communication allowing for integration with e.g. wireless home automation systems, etc.

A challenge with LEDs is that heat generated by the LEDs is mainly dissipated in a non-lighting direction, in comparison to e.g. an incandescent light bulb dissipating heat in the direction of the light. The heat generated by the LEDs during operation hence needs to be handled efficiently. This is usually taken care of by a metal heat sink which is, at least, arranged to dissipate heat to the ambient air of the environment. However, the provision of a metallic heat sink in e.g. close vicinity of wireless communication antennas provides for a problematic environment since the bulky metal may interact, through loading and shielding, with the antenna to negatively impact the quality of radio communication.

US 2011/0 006 898 presents an approach to solve this problem. Specifically, in US 2011/0 006 898, an antenna element is positioned on the surface of the heat sink. However, such implementation introduces complicated signal connection paths, resulting in an expensive end component. Accordingly, there is a need for further improvements in terms of e.g. cost efficiency and wireless signal communication quality improvements, etc.

SUMMARY OF THE INVENTION

It is an object of the present invention to provide an improved lighting assembly in order to at least partly overcome the above mentioned problems.

According to an aspect of the present invention there is provided a lighting assembly, comprising at least one light source, a heat sink for dissipating heat generated during operation of the at least one light source, a lamp foot for connecting the at least one light source to a power supply, a control unit for controlling the at least one light source, and a first antenna arrangement connected to the control unit and being electrically insulated from the heat sink, wherein the heat sink and the lamp foot form a second antenna arrangement, and the first antenna arrangement is arranged in close vicinity of the second antenna arrangement for allowing near-field coupling of a radio frequency signal provided to control the at least one light source.

The present invention is based on the insight that heat sink and the lamp foot of a lighting assembly may form an antenna arrangement usable for wireless control of the at least one light source. Also, by providing a first antenna arrangement with the lighting assembly, the second antenna arrangement may couple a near-field radio frequency to the first antenna arrangement in order to control e.g. the characteristics of light emitted by the at least one light source. Accordingly, an advantage of the present invention is, at least, that an antenna arrangement is provided for the lighting assembly without substantially violating the already limited space available for such an arrangement. Also, the shape of an already present lamp foot and heat sink may provide a second antenna arrangement having a relatively broad bandwidth. This may be beneficial since the antenna arrangement therefore is less sensitive to centre frequency shifting, which may occur when, for example, the lighting assembly is inserted into e.g. a luminaire which will load the first antenna arrangement. Furthermore, by arranging the heat sink and the lamp foot as a second antenna arrangement and thereby, as described above, utilize the already present structure of the lighting assembly as an antenna arrangement, there is no need of positioning an antenna arrangement onto the external structure of the lighting assembly. Moreover, by providing the antenna arrangements as described above, i.e. by means of near-field coupling, there is no need of an ohmic connection of the second antenna arrangement to the mains network. An advantage is, at least, that the second antenna arrangement, i.e. the heat sink and the lamp foot, will be electrically insulated from the mains supply, thereby providing an increased safety for e.g. a user of the lighting assembly.

According to an example embodiment of the present invention, the heat sink and the lamp foot may be electrically insulated and arranged at a predefined distance from each other. Furthermore, the second antenna arrangement may form a dipole antenna having a first conductor element formed by the lamp foot and a second conductor element formed by the heat sink. Accordingly, the predefined distance between the heat sink and the lamp foot form a gap of the dipole antenna. An advantage is, at least, that the electrically insulated gap between the heat sink and the lamp foot may provide a beneficial environment for coupling a radio frequency signal between the second antenna arrangement and the first antenna arrangement when, for example, wirelessly controlling the lighting assembly.

Furthermore, the lighting assembly may be a retrofit lighting assembly connectable to a standard socket (by means of the lamp foot), and the heat sink may be a conic shaped heat sink. The lamp foot may hence be arranged in a plurality of shapes and sizes to fit with a socket having e.g. standard dimensions E14, E17, E26, E27, E39, etc. Also, the conic shape of the heat sink may enable for a broad bandwidth dipole antenna, which may be comparable to e.g. already known bow-tie antennas or log-periodic antennas having a relatively broad bandwidth. An advantage of having a broad bandwidth is, as also described above, that the antenna arrangement may be less sensitive to centre frequency shifting, which may occur when e.g. the lighting assembly is inserted into e.g. a luminaire which will load the first antenna arrangement.

Furthermore, the first antenna arrangement may be provided inside the lighting assembly being at least partially enclosed by the heat sink. The first antenna arrangement may act as an excitation antenna and may hence be the only one of the first and the second antenna arrangement which is electrically connected to the mains network. Accordingly, by providing the first antenna arrangement within the lighting assembly, the electrically connected first antenna arrangement will not be accessible from the exterior, which in turn further increases the safety for a user handling the lighting assembly.

According to an example embodiment, the first antenna arrangement may be provided on a printed circuit board connected to the at least one light source. An advantage is that an already present printed circuit board arranged within the lighting assembly may be provided with the first antenna arrangement, thereby not increasing the number of components and the complexity of the lighting assembly.

According to another example embodiment of the present invention, the first antenna arrangement may be formed by a ring-shaped metallic conductor element connected to the at least one light source. Hereby, a relatively simple metallic object may be connected to the light source for providing an antenna element. Another advantage is that a relatively compact element may be provided which may efficiently couple to the above described gap between the heat sink and the lamp foot.

Moreover, the antenna arrangements may be configured to operate at a radio frequency of at least 2 GHz. The dimensioning of the elements constituted by the second antenna arrangement, i.e. the heat sink and the lamp foot, is readily understood and can be implemented by the skilled addressee. For example, if implementing the present invention to a retrofit lighting assembly where the heat sink and the lamp foot has a height of e.g. approximately 3 cm, the use of a 2.4 GHz radio frequency level may be suitable according to standardized dipole antenna calculations. However, the present invention should not be construed as limited to the use of specific dimensions of the heat sink and the lamp foot which may be provided in many other configurations as well.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing example embodiments of the invention, wherein.

DETAILED DESCRIPTION

Figure 1:
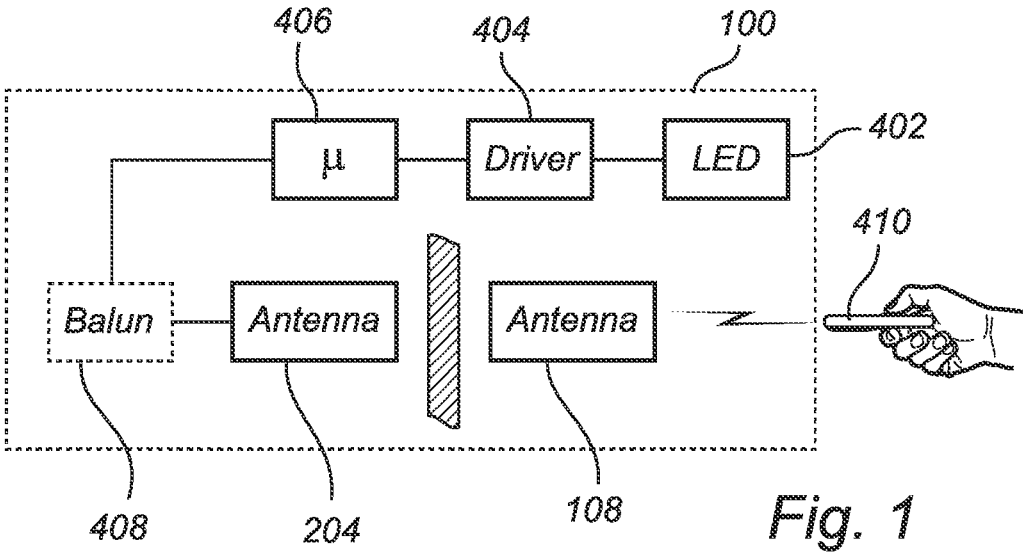
FIG. 1 is a block diagram illustrating a schematic circuit for wireless radio frequency control of the lighting assembly according to the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted an embodiment of a general concept for a lighting assembly 100 according to the present invention. In more detail, FIG. 1 illustrates a block diagram of a schematic circuit for wireless radio frequency control of the lighting assembly 100. As is depicted in FIG. 1, at least one light source 402 is connected to a driver 404 for electrically connecting the at least one light source to the mains network. In the following, the at least one light source 402 will be described as an LED array. The driver 404 is in turn in connection with a control circuit 406 configured to control e.g. the characteristics and functions of the LED array 402. Furthermore, the control circuit 406 is also configured to function as a radio frequency chip that generates and demodulates the radio frequency received from and provided to the antennas. The control circuit 406 may, for example, comprise a microprocessor, microcontroller, digital signal processor or other programmable device. Moreover, the control circuit 406 is in connection to a first antenna arrangement provided inside the lighting assembly, in the following referred to as an internal antenna arrangement 204. The internal antenna arrangement 204 and examples of connections to the control circuit 406 will be described further below in relation to the description of FIGS. 3 and 4. Furthermore, the internal antenna arrangement 204 is thereafter coupled to a second antenna arrangement. The second antenna arrangement will in the following be referred to as a dipole antenna arrangement 108 which is formed by the heat sink 102 and the lamp foot 104 of the lighting assembly. A more detailed description of the dipole antenna arrangement 108 will be provided below with reference to the description of FIG. 2. The internal antenna arrangement 204 is at least partly insulated from the dipole antenna arrangement 108 and configured for near-field radio frequency coupling between the two antenna arrangements. More specifically and according to an example, the internal antenna arrangement 204 is insulated from the heat sink 102 forming one part of the dipole antenna arrangement 108.

According to an embodiment, a balun 408 may be connected between the control circuit 406 and the internal antenna arrangement 204 and configured to convert balanced electrical signals to unbalanced signals, or vice versa. Many different types of baluns can be used, as known to those skilled in the art, and the invention is therefore not limited to any specific type. Moreover, the balun 408 may also be arranged to act as an antenna impedance matching network.

In order to control the lighting assembly 100 described above, a signal may be provided from e.g. a remote control 410 sending a signal indicative of a desired action to be provided to the LED array 402. The wireless signal is received by the dipole antenna arrangement 108 formed by the heat sink 102 and the lamp foot 104 and thereafter coupled by near-field radio frequency signals to the internal antenna arrangement 204. The signals may be both electric fields and magnet fields. The near-field radio frequency signals received by the internal antenna arrangement 204 are thereafter provided to the control circuit 406, either via the balun or directly to the control circuitry 406. Based on the information sent by the remote control 410, the control circuit 406 provides a signal to the driver 404 which in turn controls e.g. the characteristics of the LED array.

Figure 2:
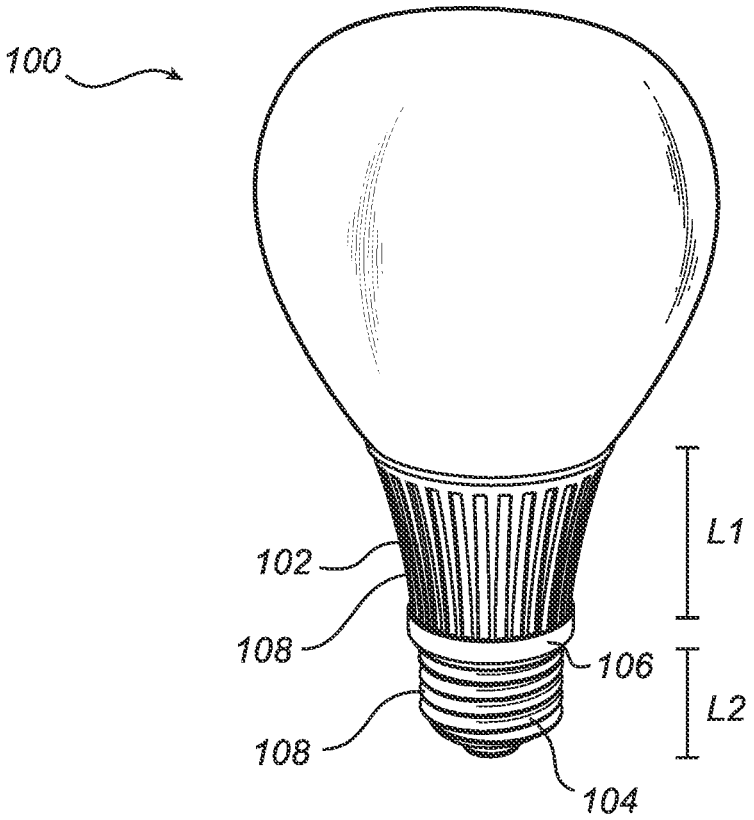
FIG. 2 is a perspective view illustrating the exterior of the lighting assembly according to an embodiment of the present invention.
Figure 3:
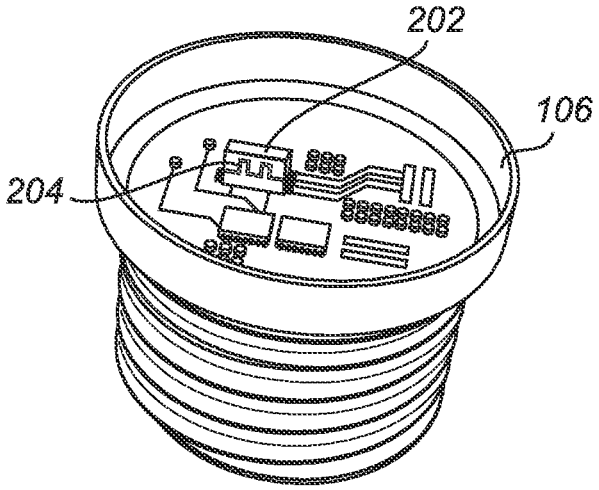
FIG. 3 is a perspective view of the interior of the lighting assembly in FIG. 2 having a first antenna arrangement provided on a printed circuit board according to an embodiment of the present invention.
Figure 4:
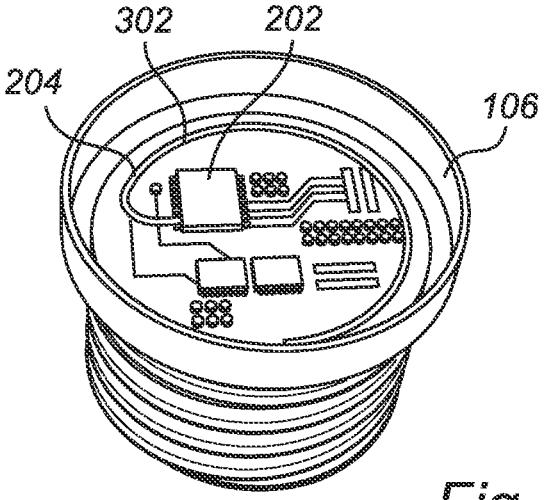
FIG. 4 is a perspective view of the interior of the lighting assembly in FIG. 2 having a ring-shaped metallic conductor forming a first antenna arrangement according to an embodiment of the present invention.

In order to describe the structural features and the antenna arrangements in more detail, reference is now made to FIGS. 2-4, illustrating example embodiments according to the present invention. Starting with FIG. 2, there is depicted a perspective view of a lighting assembly 100 according to a currently preferred embodiment of the invention. As is shown, the lighting assembly 100 comprises a heat sink 102 which is, at least, arranged to transfer and dissipate heat generated by the LED array during operation. Furthermore, the lighting assembly comprises a lamp foot 104 configured for electrically connecting the lighting assembly 100 to a power supply via e.g. a socket (not shown). The heat sink 102 and the lamp foot 104 are electrically insulated and arranged at a predefined distance from each other. The electrical insulation between the heat sink 102 and the lamp foot 104 is in FIG. 2 depicted as a non-conductive spacer element 106. The non-conductive spacer element 106 may, for example, be formed by a plastic or rubber material. However, the spacing between the heat sink 102 and the lamp foot 104 may be provided in a plurality of configurations, shapes and materials as long as a relatively acceptable insulation and distance between the heat sink 102 and the lamp foot 104 are provided. Accordingly, the invention is not limited to any specific type or dimension of spacer.

Moreover, the heat sink 102, lamp foot 104 and the space between the heat sink 102 and the lamp foot 104, forms a dipole antenna arrangement 108. Accordingly, the dipole antenna 108 is constituted by a first conductor element formed by the heat sink 102 and having a first length L1, and a second conductor element formed by the lamp foot 104 and having a second length L2. According to an example, the first length L1 is 3 cm and thereby being suitable for a 2.4 GHz radio frequency level. The second length L2, which is dictated by the specific size of the lamp foot may also, according to one example, be 3 cm, but may mostly be chosen by a specific lamp foot standard to fit in e.g. a standard socket. The second length L2 may hence not critical for the specific radio frequency level operating the lighting assembly.

Attention is now drawn to FIG. 3 illustrating a perspective view of the interior of the lighting assembly depicted in FIG. 2. As is shown in FIG. 3, the lighting assembly comprises a printed circuit board 202 which is connected to the LED array of the lighting assembly 100 for controlling e.g. the characteristics of light emitted by the LED array. Furthermore, an internal antenna arrangement 204 is integrated on the printed circuit board 202. The internal antenna arrangement 204 may be an excitation antenna electrically insulated from the above described dipole antenna arrangement 108 and configured to couple a near-field radio frequency signal from/to the above mentioned dipole antenna arrangement 108. Accordingly, there is no ohmic connection between the internal antenna arrangement 204 and the dipole antenna arrangement 108. Moreover, the internal antenna arrangement 204 is in the depicted embodiment of FIG. 3 provided on a position on the printed circuit board 202 such that it is able to relatively effectively couple the near-field radio frequency signal between the dipole antenna 108 and the internal antenna 204.

Turning to FIG. 4, a further embodiment of the internal antenna arrangement is depicted. The internal antenna arrangement 204 is in FIG. 4 constituted by a ring-shaped metallic conductor element 302. The ring-shaped metallic conductor element 302 is arranged to be in connection to the LED array of the lighting assembly, via, for example, the printed circuit board or another control circuit arranged in the lighting assembly. Accordingly, a difference between the internal antenna arrangements depicted in FIG. 4 compared to the internal antenna arrangement in FIG. 3 is that the ring-shaped metallic conductor element 302 is arranged in a circumferential direction within the lighting assembly 100. Depending on e.g. the available space within the lighting assembly 100, the ring-shaped metallic conductor element 302 may be arranged differently for different kinds of lighting assemblies 100. More specifically, the ring-shaped metallic conductor element 302 can, for example, be provided with a various radius and extensions within the interior of the lighting assembly 100 depending on e.g. the available space of the interior. Different size and location of the internal antenna arrangement with respect to the spacer element 106 may provide for a varying coupling strength to the dipole antenna arrangement 108. The skilled addressee may hence dimension the internal antenna arrangement such that is fulfills the specific and desired coupling to the dipole antenna arrangement 108. The internal antenna arrangement depicted in FIG. 3 may, instead of a ring-shaped metallic conductor element 302, also be a loose wire arranged inside the lighting assembly and connected to e.g. the printed circuit board.

Furthermore, the ring-shaped metallic conductor element 302 is configured to excite the dipole antenna 108 formed by the gap between the heat sink 102 and the lamp foot 104 in a similar manner as the internal antenna 204 integrated on the printed circuit board 202 in FIG. 3 and is also electrically insulated from the above mentioned dipole antenna arrangement 108.

Even though the invention has been described with reference to specific exemplifying embodiment thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A lighting assembly, comprising:

at least one light source, a heat sink arranged for dissipating heat generated during operation of the at least one light source, forming a conductive element, a lamp foot for connecting the at least one light source to a power supply, forming a conductive element electrically insulated from the heat sink, a control unit for controlling the at least one light source, a first antenna arrangement connected to the control unit and being electrically insulated from the heat sink, and a non-conductive spacer positioned between the heat sink and the lamp foot, wherein at least a portion of the first antenna arrangement is positioned at a junction between the non-conductive spacer and the lamp foot, wherein the heat sink and the lamp foot are positioned and sized to form a second antenna arrangement comprising a dipole antenna arrangement configured to receive a predetermined radio frequency signal with a predetermined wavelength, wherein a length of the second antenna arrangement is dependent on the predetermined wavelength, which is provided to control the at least one light source, and to reradiate the received predetermined radio frequency signal as a near-field radio frequency signal, and wherein the first antenna arrangement is positioned with respect to the second antenna arrangement sufficient to allow near-field coupling of with the second antenna arrangement, such that the first antenna arrangement is configured to receive the near-field radio frequency signal from the second antenna arrangement, provided to control the at least one light source.

2. The lighting assembly according to claim 1, wherein the second antenna arrangement forms a dipole antenna having a first conductor element formed by the heat sink and a second conductor element formed by the lamp foot .

3. The lighting assembly according to claim 1, wherein the lighting assembly is a retrofit lighting assembly, the lamp foot is connectable to a standard socket, and the heat sink has a conic shape.

4. The lighting assembly according to claim 1, wherein the first antenna arrangement is provided inside the lighting assembly at least partially enclosed by the heat sink.

5. The lighting assembly according to claim 1, wherein the first antenna arrangement is integrated on a printed circuit board arranged within the lighting assembly.

6. The lighting assembly according to claim 1, wherein the first antenna arrangement is formed by a ring-shaped metallic conductor element.

7. The lighting assembly according to claim 1, wherein the antenna arrangements are configured to operate at a radio frequency of at least 2 GHz.

8. The lighting assembly according to claim 1, further comprising a balun positioned between the control unit and the first antenna arrangement, wherein the balun is arranged to act as an antenna impedance matching network.

9. The lighting assembly according to claim 1, wherein the length of the second antenna arrangement is about half the length of the predetermined wavelength.

10. The lighting assembly according to claim 1, wherein the length of the second antenna arrangement is about 6 cm.

* * * * *